US007785175B2

(12) United States Patent
Doi et al.

(10) Patent No.: US 7,785,175 B2
(45) Date of Patent: Aug. 31, 2010

(54) METHOD AND APPARATUS FOR CHEMICAL MECHANICAL POLISHING

(75) Inventors: Toshiro Doi, 3-9-26-1303, Momochihama, Sawara-ku, Fukuoka-shi, Fukuoka (JP) 814-0001; Takashi Fujita, Mitaka (JP)

(73) Assignees: Tokyo Seimitsu Co., Ltd., Tokyo (JP); Toshiro Doi, Fukuoka-shi (JP)

( * ) Notice: Subject to any disclaimer, the term of this patent is extended or adjusted under 35 U.S.C. 154(b) by 0 days.

(21) Appl. No.: 11/133,195

(22) Filed: May 20, 2005

(65) Prior Publication Data

US 2005/0205433 A1 Sep. 22, 2005

Related U.S. Application Data

(62) Division of application No. 10/437,408, filed on May 14, 2003, now Pat. No. 6,969,308.

(30) Foreign Application Priority Data

May 17, 2002 (JP) ..... 2002-142632

(51) Int. Cl.
*B24B 1/00* (2006.01)

(52) U.S. Cl. ..... 451/64; 451/285; 438/693; 205/88

(58) Field of Classification Search ..... 451/285–289, 451/64, 65, 67; 205/88, 222, 662, 663, 123, 205/93; 438/692, 693
See application file for complete search history.

(56) References Cited

U.S. PATENT DOCUMENTS 2,182,952 A * 12/1939 Todd et. al. ..... 451/7
4,544,446 A * 10/1985 Cady ..... 438/689
5,160,590 A * 11/1992 Totsuka et al. ..... 205/152
6,074,284 A * 6/2000 Tani et al. ..... 451/57
6,171,467 B1 1/2001 Weihs et al.
6,241,869 B1 * 6/2001 Maeda ..... 205/137
6,368,190 B1 4/2002 Easter et al.
6,478,936 B1 11/2002 Volodarsky et al.

(Continued)

FOREIGN PATENT DOCUMENTS

JP 62-136317 6/1987

(Continued)

OTHER PUBLICATIONS

Japanese Office Action Corresponding to the Above—Identified Case Issued on Nov. 7, 2007.

*Primary Examiner*—Maurina Rachuba
(74) *Attorney, Agent, or Firm*—Roberts Mlotkowski Safran & Cole, P.C.; David S. Safran

(57) ABSTRACT

A polishing device is hermetically accommodated in a chamber containing an atmosphere having a composition different from the ambient air, so that the atmosphere around the polishing device is altered into the composition different from the ambient air, and voltage is applied between a wafer and a polishing pad to polish the wafer with an electrolytic effect. The polishing device has the atmosphere containing extremely less oxygen, preventing a surface of the wafer from oxidation and thereby providing a constant polishing rate.

9 Claims, 6 Drawing Sheets

U.S. PATENT DOCUMENTS

| | | | | |
|---|---|---|---|---|
| 6,580,053 | B1 * | 6/2003 | Voutsas | 219/121.66 |
| 6,846,227 | B2 * | 1/2005 | Sato et al. | 451/288 |
| 6,858,531 | B1 * | 2/2005 | Zhu et al. | 438/633 |
| 2003/0127435 | A1 * | 7/2003 | Voutsas | 219/121.65 |
| 2004/0000486 | A1 | 1/2004 | Preusse | |
| 2004/0009670 | A1 * | 1/2004 | Preusse et al. | 438/692 |
| 2004/0166789 | A1 | 8/2004 | Ashjaee et al. | |
| 2004/0171269 | A1 | 9/2004 | Kondo et al. | |
| 2004/0198190 | A1 | 10/2004 | Basol et al. | |

FOREIGN PATENT DOCUMENTS

| | | | |
|---|---|---|---|
| JP | 62136317 | * | 6/1987 |
| JP | 10-199832 | A | 7/1998 |
| JP | 2000-58521 | A | 2/2000 |
| JP | 2000-306874 | | 11/2000 |
| JP | 2002-121698 | A | 4/2002 |
| WO | WO 02/17411 | A1 | 2/2002 |

* cited by examiner

METHOD AND APPARATUS FOR CHEMICAL MECHANICAL POLISHING

CROSS-REFERENCE TO RELATED APPLICATION

This application is a division of U.S. patent application Ser. No. 10/437,408, filed May 14, 2003, now U.S. Pat. No. 6,969, 308.

BACKGROUND OF THE INVENTION

1. Field of the Invention

The present invention relates to a method and apparatus for polishing, and more particularly, to a method and apparatus for polishing a wafer using Chemical Mechanical Polishing (CMP).

2. Description of the Related Art

In recent years, the advance in semiconductor technologies has promoted finer design rules and multilayer wiring structures, and wafers have become larger in attempts to reduce costs. Such finer design rules have increasingly reduced the depth of focus of a stepper in a photolithography process, resulting in a difficulty to precisely provide a specified wiring width due to small roughness on a wafer surface.

Surface planarization process for each wiring layer has therefore been practiced. A Chemical Mechanical Polishing (CMP) apparatus is used in the planarization process. The apparatus dispenses slurry that contains fine abrasive grains and chemicals, while pressing a wafer surface to be planarized against a rotating polishing pad, and polishes the wafer with a combined effect of chemical and mechanical effects. The apparatus has been a candidate in recent years particularly for planarizing metal layers such as Cu wiring, W plug and the like. For the CMP process removing Cu layers, an electrochemical mechanical polishing apparatus is also proposed, which applies voltage for polishing between a work to be polished, i.e. a wafer having Cu layer thereon, and an polishing platen in order to improve the removing efficiency in polishing, reduce surface roughness, etc.

Such wafers having electrically conductive layers such as Cu and W to be polished thereon, however, have an extremely active surface, which leads to inconvenience in polishing due to a surface oxidation during a polishing process. In particular, when Cu, for example, is selectively removed by electropolishing, the electrical conductivity of the Cu surface has a significant effect on the polishing rate. An oxide layer formed on the Cu surface greatly reduces the conductivity and compromises the polishing rate that would correspond to the applied voltage. This has presented difficulty in securing a constant polishing rate.

Oxidized Cu surfaces also alter the surface hardness relative to unoxidized surface, causing a change in the mechanical strength, and thus the polishing rate. A surface oxidation on a metal layer that causes a change in the mechanical strength as well as the conductivity, therefore, presents problems that a constant polishing rate cannot be secured in a CMP apparatus using an electrolytic effect.

SUMMARY OF THE INVENTION

The present invention has been made in view of these circumstances, and it is an object of the present invention to provide a method and apparatus for CMP with electropolishing, in which an oxidation of a wafer surface, which causes a change in the electrical conductivity and mechanical strength and consequently the polishing rate, is avoided during a polishing process.

To attain the above-described objective, the present invention is directed to a method of chemical mechanical polishing for planarizing a surface of a wafer on which a conductive layer is formed, comprising the steps of: supplying slurry on a polishing pad; pressing the wafer against the polishing pad; making an atmosphere in a polishing section around the polishing pad different from ambient air; and applying voltage between the wafer and the polishing pad to polish the wafer with an electrolytic effect.

The present invention is also directed to an apparatus for chemical mechanical polishing for planarizing a surface of wafer on which a conductive layer is formed, the apparatus comprising: a polishing pad; a slurry supplying device which supplies slurry on the polishing pad; a polishing head which presses the wafer against the polishing pad; a voltage application device which applies voltage between the wafer and the polishing pad to effect electropolishing; and an atmosphere alteration device for making an atmosphere in a polishing section around the polishing pad different from ambient air, wherein the electropolishing is effected within the atmosphere having a composition different from the ambient air.

According to the present invention, the electropolishing is effected within the atmosphere having the composition different from the ambient air, so that the wafer surface is not altered and thus the polishing rate can be constant.

In a preferred aspect of the present invention, the atmosphere alteration device comprises: a chamber which hermetically accommodates the polishing section; a suction device which draws gas from the chamber; and a gas supply device which supplies gas having the composition different from the ambient air into the chamber. According to the present invention, the polishing section is hermetically accommodated within the chamber containing an atmosphere having a composition different from the ambient air, so that the wafer surface can be prevented from oxidation if the atmosphere contains, for example, extremely less oxygen.

Preferably, a loadlock chamber is connected to the chamber. Thus, the chamber hermetically accommodating the polishing section is connected to the loadlock chamber so that ambient air can be prevented from entering into the chamber when the wafer is conveyed from/into the chamber, and therefore the atmosphere in the chamber is maintained in the composition different from the ambient air.

In another preferred aspect of the present invention, the atmosphere alteration device comprises: a nozzle which locally spouts gas toward the wafer in the polishing section; and a gas supply device which supplies gas having the composition different from the ambient air to the nozzle. According to the present invention, there is provided a simplified atmosphere alteration device that can be used to alter the atmosphere around the polishing section by only supplying gas having a composition different from the ambient air through the nozzle toward the wafer in the polishing section.

Preferably, the atmosphere alteration device further comprises a gas diffusion prevention wall which covers the wafer in the polishing section to prevent the gas spouted toward the wafer from diffusing. According to the present invention, there is provided a gas-saving atmosphere alteration device that has the gas diffusion prevention wall.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

A preferred embodiment of a method and apparatus for CMP according to the present invention will now be described with reference to the drawings. In each drawing, like reference numbers and characters refer to like elements.

Figure 1:
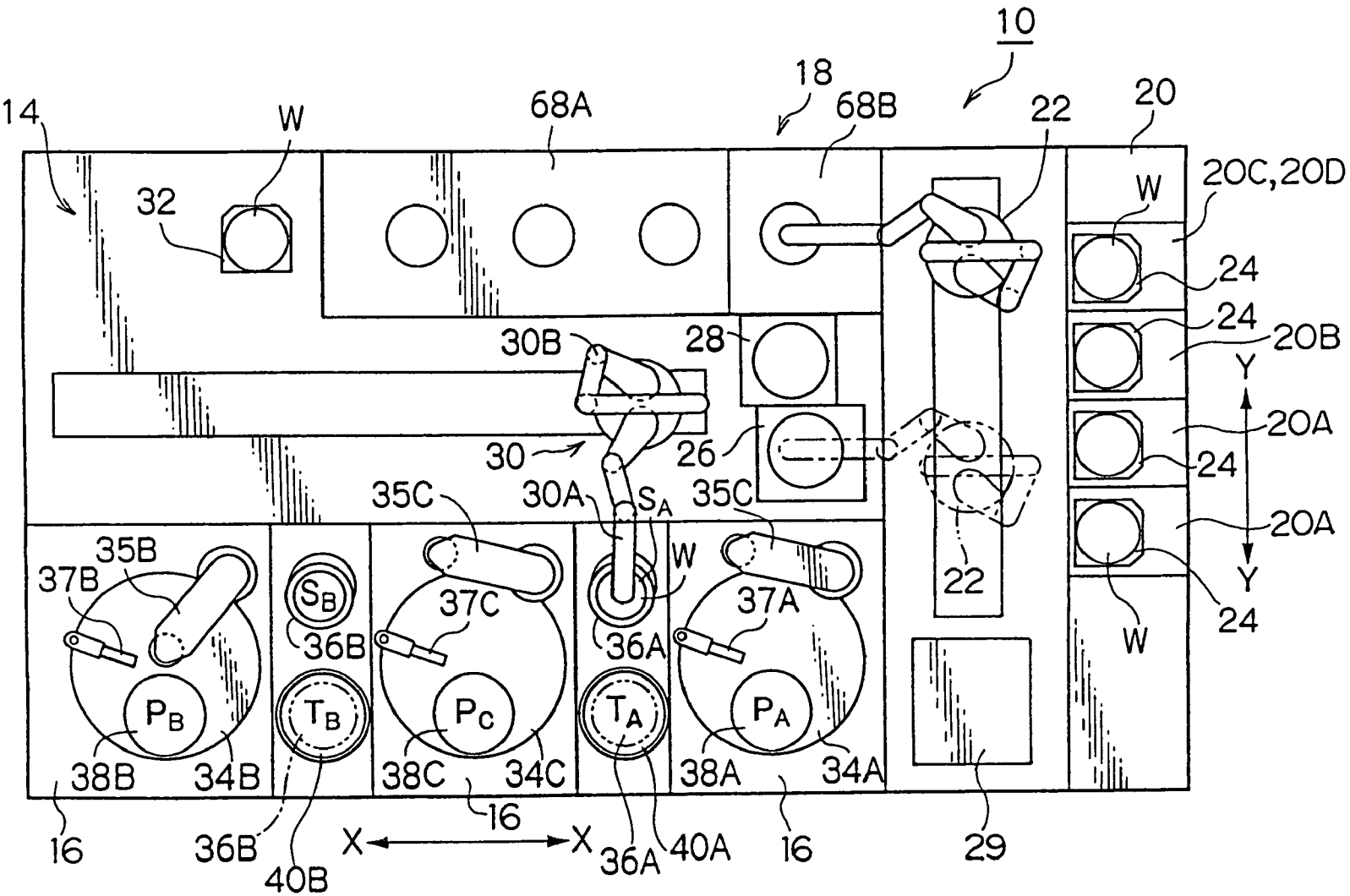
FIG. 1 shows a plan view of the entire CMP apparatus according to an embodiment of the present invention.

FIG. 1 shows a plan view illustrating an embodiment of a CMP apparatus according to the present invention. As shown in FIG. 1, a CMP apparatus 10 of the embodiment is composed of a wafer stocker 20, a transfer device 14, polishing devices 16, 16, 16 as a polishing section, a cleaning/drying device 18, a layer thickness measurement devices 26, 28, and a control section which is not shown.

The wafer stocker 20 is composed of product wafer stockers 20A, a dummy wafer stocker 20B, a first monitor wafer stocker 20C, and a second monitor wafer stocker 20D, and each stocker accommodates a wafer W contained in a cassette 24. Two product wafer stockers 20A are provided side by side. The first monitor wafer stocker 20C uses a lower portion of the cassette 24, and an upper portion of the same cassette 24 is used as the second monitor wafer stocker 20D.

The transfer device 14 is composed of an indexing robot 22, a transfer robot 30, and transfer units 36A, 36B. The indexing robot 22 includes two rotatable and bendable arms and is movable in a direction indicated by the arrow Y in FIG. 1. The indexing robot 22 picks up a wafer W to be polished from the cassette 24 placed on each wafer stocker, and conveys the wafer W to wafer stand-by positions 26, 28. The indexing robot 22 also receives a cleaned wafer W from the cleaning/drying device 18, and stores the cleaned wafer W in the cassette 24.

The transfer robot 30 includes two bendable and rotatable arms, a loading arm 30A and an unloading arm 30B, and is movable in a direction indicated by the arrow X in FIG. 1. The loading arm 30A is used to convey an unpolished wafer W; the loading arm 30A receives the unpolished wafer W from the wafer stand-by positions 26, 28 onto a pad (not shown) provided to the end thereof, and conveys the unpolished wafer W to the transfer units 36A, 36B.

The unloading arm 30B is used to convey a polished wafer W; the unloading arm 30B receives the polished wafer W from the transfer units 36A, 36B onto a pad (not shown) provided to the end thereof, and conveys the polished wafer W to the cleaning/drying device 18.

The transfer units 36A, 36B are provided to be movable in a direction indicated by the arrow Y in FIG. 1, and the transfer units 36A, 36B travel between receiving positions $S_A$, $S_B$ and relaying positions $T_A$, $T_B$, respectively. The transfer units 36A, 36B receive a wafer W to be polished from the loading arm 30A of the transfer robot 30 at $S_A$, $S_B$, and then move to the relaying position $T_A$, $T_B$ to pass the wafer W to polishing heads 38A, 38B, respectively. The transfer units 36A, 36B also receive a polished wafer W at the relaying position $T_A$, $T_B$ and then move to the receiving position $S_A$, $S_B$ to pass the polished wafer W to the unloading arm 30B of the transfer robot 30, respectively.

Each of the transfer units 36A, 36B has two separate tables; one of the tables is used for an unpolished wafer W and the other for a polished wafer W. An unload cassette 32 is provided adjacent to the cleaning/drying device 18, and is used to temporally store a polished wafer W. For example, a polished wafer W is transferred by the transfer robot 30 and temporally stored in the unload cassette 32 when the cleaning/drying device 18 is not operated.

The polishing devices 16, 16, 16 are utilized to polish a wafer and include polishing platens 34A, 34B, 34C, polishing heads 38A, 38B, slurry supply nozzles 37A, 37B, 37C and carrier cleaning units 40A, 40B, as shown in FIG. 1. Each of the polishing platens 34A, 34B, 34C is formed in a disk shape, and the three platens are arranged in line. A polishing pad is applied to the upper surface of each of the polishing platens 34A, 34B, 34C, and slurry is supplied from the slurry supply nozzles 37A, 37B, 37C onto the polishing pads.

The right and left polishing platens 34A, 34B of the three polishing platens 34A, 34B, 34C are used to polish a first type of layer to be polished (for example, Cu layer) and the center polishing platen 34C is used to polish a second type of layer to be polished (for example, Ta layer). The polishing processes for the different types of layer use different types of supplied slurry, different rotations of the polishing head and polishing platen, different pressing force of the polishing head, and different materials of the polishing pad from each other.

Dressing devices 35A, 35B, 35C are provided near the polishing platens 34A, 34B, 34C, respectively. Each of the dressing devices 35A, 35B, 35C includes a rotatable arm, and a dresser on the end of the arm is used to dress a polishing pad on each of the polishing platens 34A, 34B, 34C.

Two polishing heads 38A, 38B are provided, and each of them can move in a direction indicated by the arrow X in FIG. 1.

Figure 2:
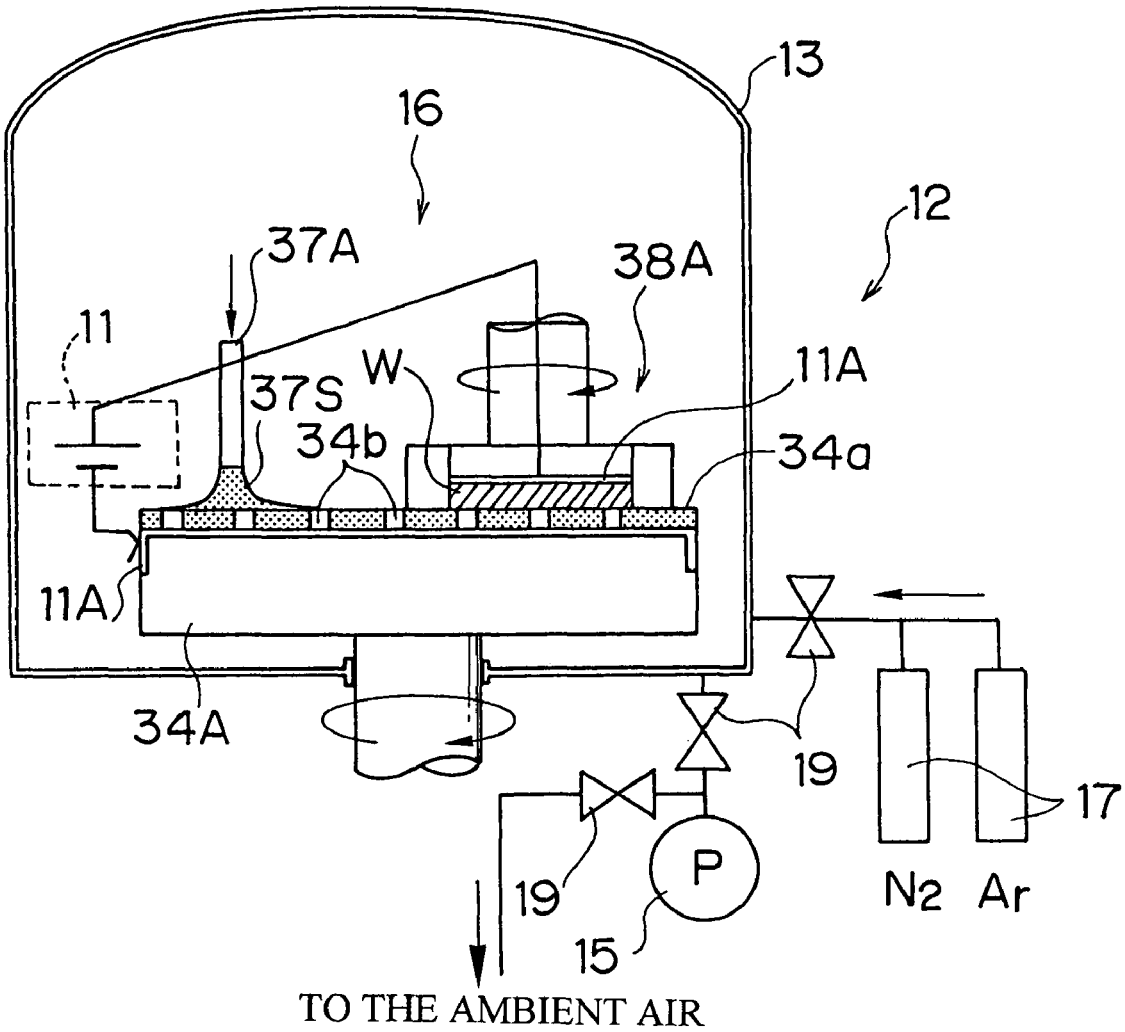
FIG. 2 shows a sectional view illustrating a polishing device of a CMP apparatus according to an embodiment of the present invention.

FIG. 2 shows an enlarged sectional view of the polishing device 16 used as a polishing section. The polishing device 16 will now be described in detail with reference to FIG. 2. The polishing device 16 is composed of an polishing platen 34A, a polishing pad 34*a* applied to the upper surface of the polishing platen 34A, a polishing head 38A, a direct current (DC) power supply 11 used as a voltage application device for applying voltage between a wafer W and the polishing pad 34*a*, a slurry supply nozzle 37A that supplies slurry 37S onto the polishing pad 34*a*, conductive films 11A applied to a wafer holding surface of the polishing head 38A and the back side of the polishing pad 34*a*, and the like.

The polishing platen 34A is driven by an electric motor (not shown). The polishing head 38A is also driven by an electric motor (now shown) and forced down to press a wafer W against the polishing pad 34*a*. A large number of small holes 34*b* are formed in the polishing pad 34*a* and the slurry 37S fills up the holes 34*b*.

The positive terminal of the DC power supply 11 is connected to one conductive film 11A applied to the wafer holding surface of the polishing head 38A, and the negative terminal of the DC power supply 11 is connected to the other conductive film 11A applied to the back side of the polishing pad 34*a*, creating a potential difference between the wafer W and the back side of the polishing pad 34*a*.

The polishing device 16 is surrounded with an atmosphere supplied by an atmosphere alteration device 12 supplying the atmosphere having a different composition from ambient air, as shown in the FIG. 2. The atmosphere alteration device 12 is composed of a chamber 13 hermetically accommodating the polishing device 16, a vacuum pump (suction device) 15 for drawing gas from the chamber 13 to release the gas into ambient air, and gas cylinders 17, 17 for supplying gas having a composition different from ambient air into the chamber 13. The vacuum pump 15 has valves 19 on the chamber 13 end and the releasing end, respectively, and another valve 19 is provided for the gas cylinders 17, 17. These valves are controlled to open and close by a control section.

A nitrogen ($N_2$) gas cylinder and an argon (Ar) gas cylinders are used as the gas cylinders 17, 17, and the chamber 13 is filled with the atmosphere that contains extremely less oxygen. Thus, a metal layer formed on the surface of wafer W can be prevented from oxidation.

With the polishing device 16 configured as described above, a wafer W held by the polishing head 38A is pressed against the polishing pad 34*a* and polished with CMP by rotating the polishing platen 34A and polishing head 38A and supplying the slurry 37S onto the polishing pad 34*a*. At the same time, a metal layer on the surface of the wafer W is electropolished because a positive potential is applied from the DC power supply 11 to the wafer W through one conductive film 11A contacted to the wafer W in the vicinity of the edge on the obverse surface of the wafer W from the reverse surface via the periphery of the wafer W, and a negative potential is applied to the other conductive film 11A attached to the back side of the polishing pad 34*a*. Another polishing head 38B has the similar configuration.

As shown in FIG. 1, two carrier cleaning units 40A, 40B are provided between the polishing platens 34A, 34B, 34C, and located in the predetermined relaying positions $T_A$, $T_B$ of the transfer units 36A, 36B, respectively. The carrier cleaning units 40A, 40B are used to clean carriers of the polishing heads 38A, 38B after the polishing.

The cleaning/drying device 18 is used to clean a polished wafer W. The cleaning/drying device 18 includes a cleaning device 68A and a drying device 68B. The cleaning device 68A has three cleaning baths for alkali cleaning, acid cleaning and rinsing. A wafer W polished in the polishing devices 16, 16, 16 is conveyed to the cleaning/drying device 18 by the transfer robot 30, subject to acid cleaning, alkali cleaning and rinsing in the cleaning device 68A of the cleaning/drying device 18, and dried in the drying device 68B. The dried wafer W is removed from the drying device 68B by the indexing robot 22 of the transfer device 14, and stored in a predetermined position of a cassette 24 placed on the wafer stocker 20.

The CMP apparatus 10 with electropolishing according to the present invention has a configuration as described above, and thus an oxidation of a metal layer can be suppressed in planarization of a wafer W on which a metal layer, such as Cu and Al wiring, is formed. This efficiently provides a stabilized planarization.

Figure 3:
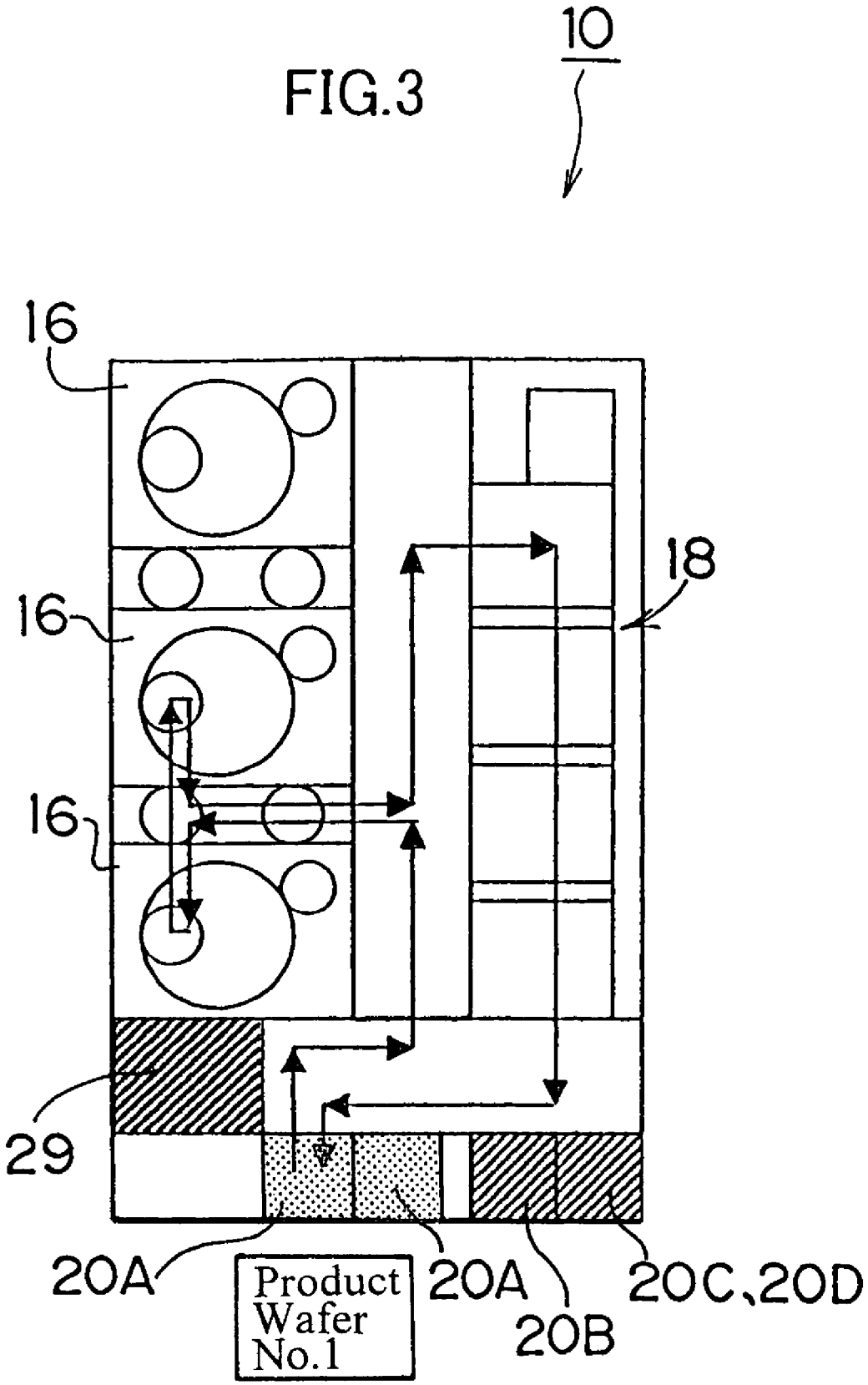
FIG. 3 shows a plan view illustrating a wafer flow of the CMP apparatus.

The CMP apparatus 10 configured as described above processes a wafer W as follows. FIG. 3 shows a flow of a wafer W in the CMP apparatus 10.

As shown in FIGS. 1, 2, and 3, a wafer W stored in a cassette 24 is first removed by the indexing robot 22 and conveyed to the layer thickness measurement device 26. The wafer is centered and, as required, measured for the layer thickness in the layer thickness measurement device 26. The centered wafer W is removed from the layer thickness measurement device 26 by the loading arm 30A of the transfer robot 30, and conveyed to the transfer unit 36A. A loading table waits in advance at the predetermined receiving position $S_A$ in the transfer unit 36A, and the wafer W is received by the loading table positioned at the receiving position $S_A$ from the loading arm 30A. The loading table having received the wafer W advances and moves to the predetermined relaying position $T_A$. The polishing head 38A waits in advance above the relaying position $T_A$, and the wafer W is passed to the polishing head 38A from the loading table.

After the polishing head 38A receives the wafer W, the vacuum pump 15 connected to the chamber 13 accommodating the polishing device 16 is operated, and the valves 19, 19 of the vacuum pump 15 are opened to draw an atmosphere from the chamber 13 and release the atmosphere out of the chamber 13. The valve 19 for the gas cylinders 17, 17 is also opened to supply a mixture of $N_2$ and Ar gas into the chamber 13, and after a predetermined time, the valve 19 is closed and the pump 15 is stopped.

The polishing head 38A having received the wafer W holds the wafer W by suction via the conductive film 11A, and moves to a predetermined polishing position PA. The suction is then released at the position, and the wafer W is placed on the polishing pad 34*a* so that the wafer W is polished. The wafer W is polished by rotating both the polishing platen 34A and the polishing head 38A while the wafer W is pressed against the polishing pad 34*a* using the polishing head 38A, and supplying the slurry 37S from the slurry supply nozzle 37A onto the rotating polishing pad 34*a*. Electropolishing is simultaneously started by the DC power supply 11.

The back side of the polishing pad 34*a* is connected to the negative terminal of the DC power supply 11 via one conductive film 11A. The wafer W is connected to the positive terminal of the DC power supply 11 via the other conductive film 11A in electrical communication with the vicinity of an edge on the obverse surface of the wafer W. Thereby, a potential difference is created between the obverse surface of the wafer W and the back side of the polishing pad 34*a*. Since a large number of holes 34*b* in the polishing pad 34*a* are filled with the slurry 37S that is conductive fluid containing a large amount of ions, the potential difference causes an electro-elution on the obverse surface of the wafer W that is an anode. The removing effect of the electro-elution, the chemical removing effect of chemical contents in the slurry 37S, and the mechanical removing effect of abrasive grains in the slurry 37S are provided simultaneously to polish a first type of layer to be polished (for example, Cu layer) on the surface of the wafer W.

The polished wafer W is again held by suction and brought back from the polishing platen 34A. If a second type of layer (for example, Ta layer) is to be polished, the polishing head 38A is directly moved to a polishing position Pc on the center polishing platen 34C. The second type of layer is then polished on the center polishing platen 34C with polishing conditions different from those for the first type of layer polished on the polishing platen 34A. The wafer W is also be polished in an atmosphere that contains extremely less oxygen. Alternatively, if only the first type of layer should be polished to terminate the process, the polishing head 38A is moved to the predetermined relying position $T_A$. The wafer W is then passed to an unloading table of the transfer unit 36A positioned in advance at the relaying position $T_A$.

After the second layer is polished on the center polishing platen 34C, the polishing head 38A is moved from the polishing position $P_C$ to the relaying position $T_A$, and passes the wafer W to the unloading table.

The unloading table of the transfer unit 36A having received the polished wafer W at the relaying position $T_A$ is moved backward to the predetermined receiving position $S_A$. The wafer W is then removed from the unloading table positioned at the receiving position $S_A$ by the unloading arm 30B of the transfer robot 30, and conveyed to the cleaning/drying device 18.

The wafer W conveyed to the cleaning/drying device 18 is subject to acid cleaning, alkali cleaning and rinsing in the cleaning device 68A, and then dried in the drying device 68B. The wafer W dried in the drying device 68B is removed from the drying device 68B by the indexing robot 22 of the transfer device 14, and, if required, conveyed to the layer thickness measurement device 26 where the wafer W is measured for the thickness of layer, and then stored in a predetermined position of the cassette 24 placed on the wafer stocker 20, again using the indexing robot 22. A polishing process of one wafer W is completed through a series of processes described above.

Figure 4:
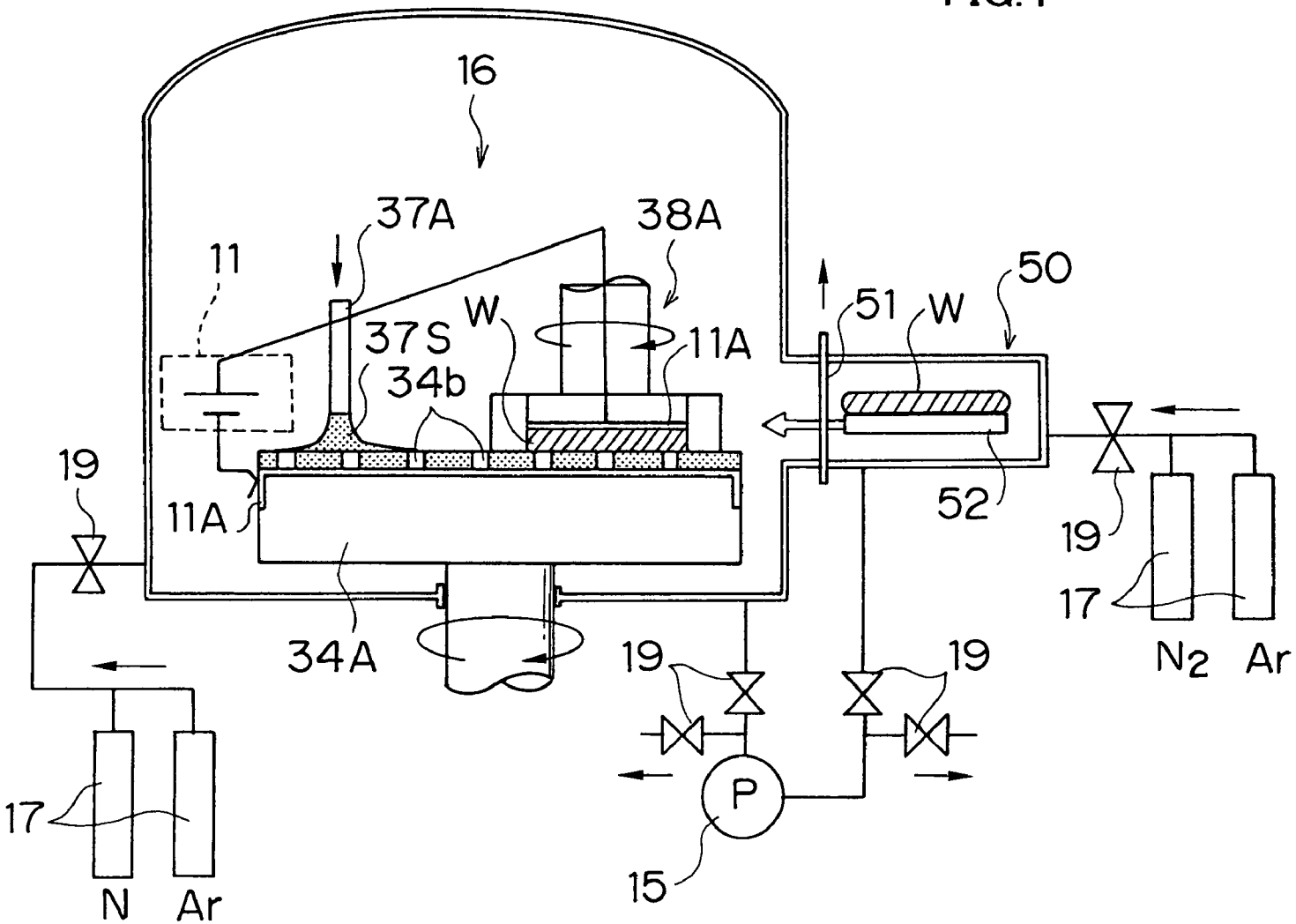
FIG. 4 shows a sectional view illustrating a further embodiment.

FIG. 4 shows a cross-sectional side view of an embodiment illustrating the chamber 13 of the embodiment described above connected to a loadlock chamber 50. As shown in FIG. 4, the chamber 13 is adapted to receive and send a wafer W through the loadlock chamber 50. The loadlock chamber 50 is connected to the chamber 13 via a gate shutter 51. The loadlock chamber 50 is also connected to the vacuum pump 15, as well as the gas cylinders 17, 17. A transfer robot 52 used to convey a wafer W is located in the loadlock chamber 50.

When a wafer W is conveyed into the chamber 13, a door (not shown) of the loadlock chamber 50 is first opened, the wafer W is placed on the transfer robot, and then the door is closed. The vacuum pump 15 is then operated, and the valve 19 on the loadlock chamber 50 side is opened to draw a gas from the loadlock chamber 50. At the same time, the valve 19 for the gas cylinders 17, 17 is opened to supply a gas, and then closed after a predetermined time. This fills the loadlock chamber 50 with a gas containing no oxygen. The gate shutter 51 is then opened, and the wafer W is conveyed into the chamber 13 by the transfer robot 52. The transfer robot 52 is then returned to the loadlock chamber 50, and the gate shutter 51 is closed. Thus, the wafer W can be conveyed into/from the chamber 13 while preventing ambient air from entering the chamber 13.

Figure 5A:
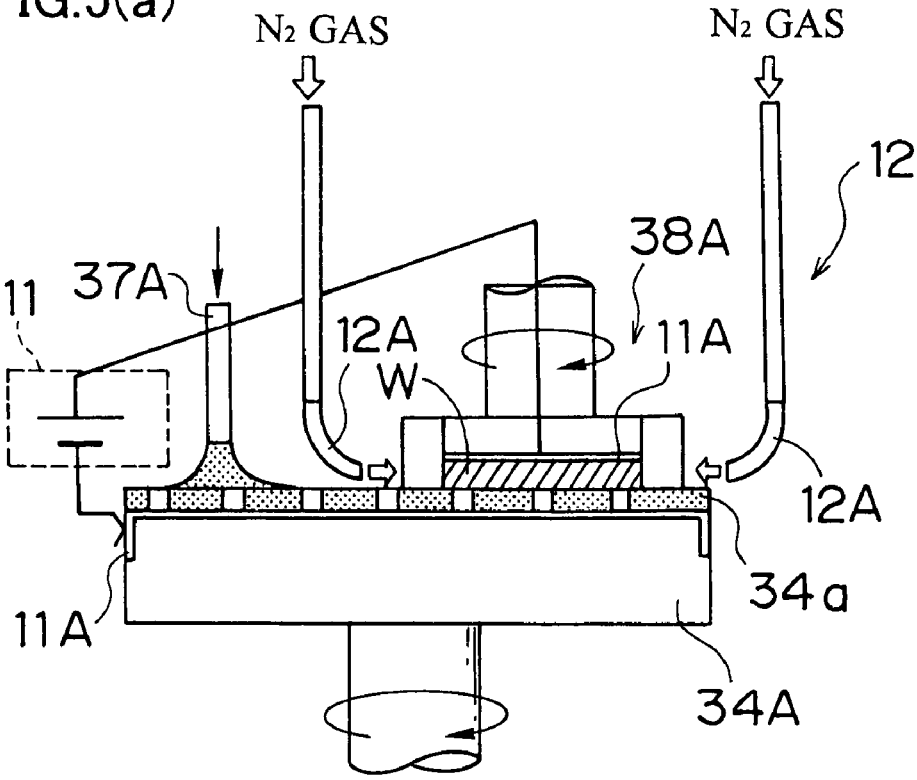
FIGS. 5(*a*) and 5(*b*) show a sectional view and a plan view illustrating a simplified atmosphere alteration device.
Figure 5B:
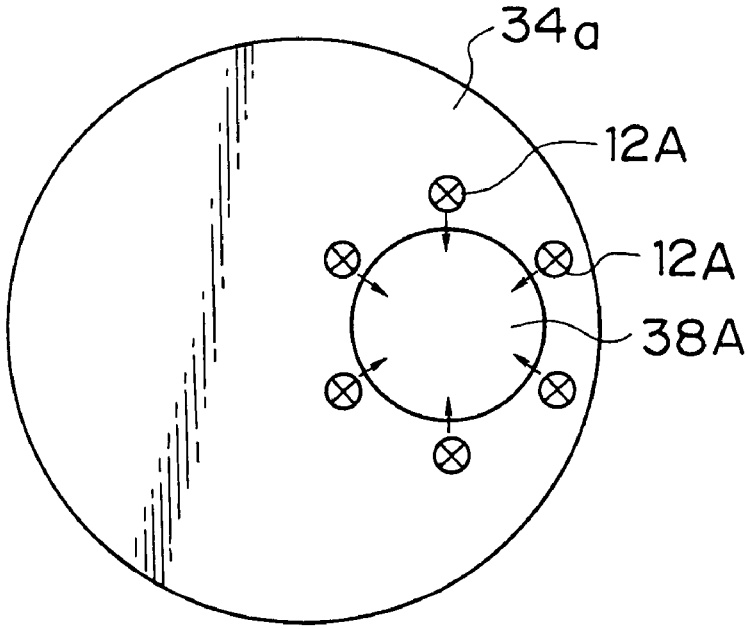

FIGS. 5(*a*) and 5(*b*) illustrate an embodiment of a simplified atmosphere alteration device 12. FIG. 5(*a*) shows a cross-sectional side view, and FIG. 5(*b*) a plan view. As shown in FIGS. 5(*a*) and 5(*b*), the simplified atmosphere alteration device 12 is provided with six nozzles 12A, 12A, . . . , adjacent to the periphery of the polishing head 38A. These nozzles 12A, 12A, . . . , are connected to gas cylinders (not shown) to spout, for example, $N_2$ gas toward a wafer W while the wafer W is processed, maintaining the atmosphere to contain less oxygen around the wafer W. Other portions similar to the embodiment shown in FIG. 2 will not be described. According to the embodiment shown in FIGS. 5(*a*) and 5(*b*), the atmosphere in the processing section can be altered with the simpler configuration.

Figure 6:
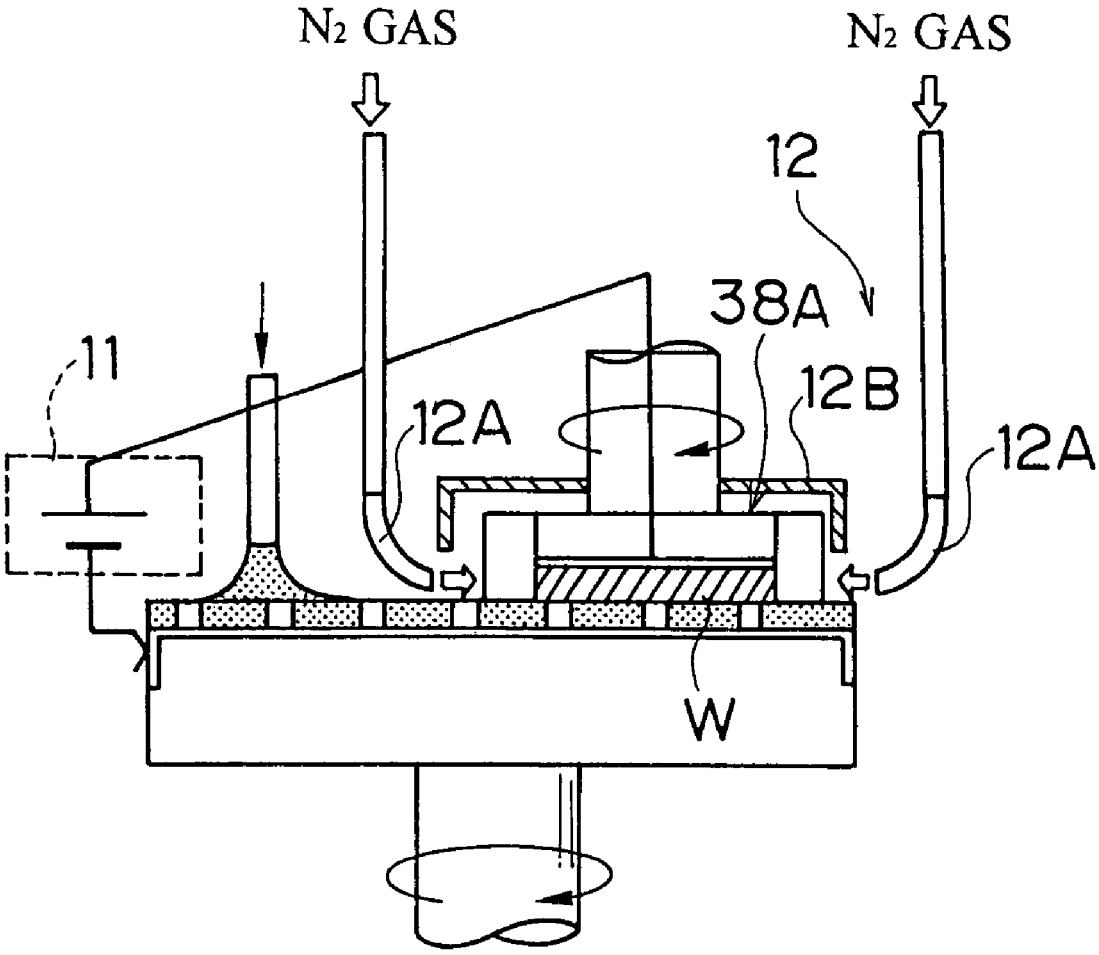
FIG. 6 shows a sectional view illustrating a variation of a simplified atmosphere alteration device.

FIG. 6 shows cross-sectional side view illustrating a variation of the embodiment shown in FIGS. 5(*a*) and 5(*b*). The variation in FIG. 6 is provided with a gas diffusion prevention wall 12B to cover the polishing head 38A over the periphery of the polishing head 38A. Other portions similar to the embodiment shown in the FIGS. 5(*a*) and 5(*b*) will not be described. According to the variation shown in FIG. 6, the gas to be spouted toward a wafer W can be reduced and saved.

Although an atmosphere in a polishing section has been altered to gas having a different composition from ambient air (for example, $N_2$ or Ar gas) in the embodiments of the present invention described above, the present invention is not limited to this particular embodiment, and air containing less oxygen may also supplied or low pressure may be used.

As described above, electropolishing can be effected within an atmosphere having a different composition from ambient air according to the present invention, and there is provided a method and apparatus for CMP with electropolishing, in which the surface of metal formed on a wafer surface is not altered and thus the polishing rate is constant.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A method of chemical mechanical polishing for planarizing a surface of a wafer on which a conductive layer is formed, comprising the steps of:

supplying slurry on a polishing pad;

pressing the wafer against the polishing pad;

making a gaseous atmosphere in a polishing section where the wafer is being pressed against the polishing pad that is oxygen reduced relative to the ambient air; and applying voltage between the wafer and the polishing pad to polish the wafer with an electrolytic effect;

wherein the oxygen reduced gaseous atmosphere is made by directing a flow of the oxygen reduced gaseous atmosphere from a plurality of spouts to the polishing section, the plurality of spouts being positioned surrounding the polishing section in close proximity to the polishing pad and being oriented to create oxygen reduced gaseous atmosphere over only an area located between the plurality of spouts.

2. The method of chemical mechanical polishing as defined in claim 1, wherein the polishing section is enclosed within a chamber and the oxygen reduced gaseous atmosphere is made in said chamber after drawing the ambient air from the chamber.

3. The method of chemical mechanical polishing as defined in claim 2, wherein the oxygen reduced gaseous atmosphere is made by supplying at least one of nitrogen and argon into said chamber.

4. The method of chemical mechanical polishing as defined in claim 1, wherein the oxygen reduced gaseous atmosphere is made using at least one of nitrogen and argon.

5. A method of chemical mechanical polishing as defined in claim 1, wherein the oxygen reduced gaseous atmosphere is made by directing a flow of the oxygen reduced gaseous atmosphere from the spouts disposed within the enclosed chamber, an outlet of the each of the spouts being pointed in a direction toward the polishing pad.

6. A method of chemical mechanical polishing for planarizing a surface of a wafer on which a conductive layer is formed, comprising the steps of:

providing a polishing pad and a wafer on a polishing platen;

supplying slurry on the polishing pad;

pressing the wafer against the polishing pad;

making a gaseous atmosphere only around a polishing section where the wafer is being pressed against the polishing pad by the polishing platen that is oxygen reduced relative to the ambient air;

and applying voltage between the wafer and the polishing pad to polish the wafer with an electrolytic effect;

wherein the step of making the oxygen reduced gaseous atmosphere is performed to direct an oxygen reduced gaseous atmosphere only toward the wafer from positions surrounding the polishing platen.

7. A method of chemical mechanical polishing as defined in claim 6, wherein the step of making an oxygen reduced gaseous atmosphere is performed by directing a flow of an oxygen reduced gas toward the polishing section from an area in proximity to the polishing section.

8. A method of chemical mechanical polishing for planarizing a surface of a wafer on which a conductive layer is formed, comprising the steps of:

providing a polishing pad and a wafer on a polishing platen within an enclosed chamber;

supplying slurry on the polishing pad;

pressing the wafer against the polishing pad;

making a gaseous atmosphere in a polishing section around the polishing pad within the chamber that is oxygen reduced relative to the ambient air; and applying voltage between the wafer and the polishing pad to polish the wafer with an electrolytic effect;

wherein the step of making an oxygen reduced gaseous atmosphere is performed by preventing the intrusion of oxygen in proximity to an area in which the wafer is pressed against the polishing pad by directing an oxygen reduced gas only toward the wafer only at positions surrounding the polishing platen.

9. A method of chemical mechanical polishing as defined in claim 8, wherein the preventing of the intrusion of oxygen at an area in proximity to the polishing section is performed by directing a flow of an oxygen reduced gas toward the polishing section from an area that is local to the polishing section.

* * * * *